US008459649B2

(12) United States Patent
Walker

(10) Patent No.: US 8,459,649 B2
(45) Date of Patent: Jun. 11, 2013

(54) BOARD GAME STORABLE SLEEPING BAG AND METHOD

(76) Inventor: Preston Walker, Union City, GA (US)

( * ) Notice: Subject to any disclaimer, the term of this patent is extended or adjusted under 35 U.S.C. 154(b) by 0 days.

(21) Appl. No.: 13/474,621

(22) Filed: May 17, 2012

(65) Prior Publication Data

US 2012/0292853 A1 Nov. 22, 2012

Related U.S. Application Data

(60) Provisional application No. 61/487,074, filed on May 17, 2011.

(51) Int. Cl.
*A63F 3/00* (2006.01)

(52) U.S. Cl.
USPC ..... 273/286; 273/288

(58) Field of Classification Search
USPC ..... 273/288, 285, 286
See application file for complete search history.

(56) References Cited

U.S. PATENT DOCUMENTS

| | | | | |
|---|---|---|---|---|
| 4,972,533 | A * | 11/1990 | Brown | 5/413 R |
| 6,158,068 | A | 12/2000 | Pariseau | |
| 6,952,845 | B1 * | 10/2005 | Akkad | 5/419 |
| 7,051,387 | B1 * | 5/2006 | Yoder et al. | 5/413 R |
| 2005/0173860 | A1 * | 8/2005 | Enebo | 273/260 |
| 2006/0075554 | A1 | 4/2006 | Zheng | |

* cited by examiner

*Primary Examiner* — Vishu K. Mendiratta
(74) *Attorney, Agent, or Firm* — Daniel Boudwin

(57) ABSTRACT

Disclosed is a combination sleeping bag and means for storing a game board device within the sleeping bag structure, along with an associated method of storing flexible game boards and game pieces within a sleeping bag for travel and storage use. The sleeping bag comprises a folded and zipperable blanket having familiar design aspects, wherein within the interior of the bag is a removable blanket liner. The blanket comprises a board game design on its surface such that it can be removed from the bag and utilized as a game board, wherein the blanket otherwise attaches along the interior surface of the bag. A securable pouch within the sleeping bag is provided for containing compressible or flexible game pieces associated with the given game board, while the exterior of the bag may be adorned in a logo illustrating the exact game or games stored within the bag.

3 Claims, 3 Drawing Sheets

BOARD GAME STORABLE SLEEPING BAG AND METHOD

CROSS REFERENCE TO RELATED APPLICATION

This application claims the benefit of U.S. Provisional Application No. 61/487,074 filed on May 17, 2011, entitled "Sleeping Bags-Game Bags and Blanket." The patent application identified above is incorporated here by reference in its entirety to provide continuity of disclosure.

BACKGROUND OF THE INVENTION

1. Field of the Invention

The present invention relates to sleeping bag devices and game boards. More specifically, the present invention relates to a combination sleeping bag and internal means for securing a flexible game board blanket liner and associated game pieces. The disclosed method comprises the storage of a game board within a sleeping bag for deployment and storage when traveling with rigid game boards and game pieces is otherwise cumbersome and undesired.

A typical sleeping bag is a blanket structure that is ideally suited for travel or outdoor use, wherein the bag comprises a foldable blanket having an outer shell and an interior insulation material. Along the periphery of the blanket is a zipper that secures together the edges of the bag opposite the folded edge and along the base, wherein the upper edge is generally left accessible for allowing open air access while sleeping. These devices are well known in the art and provide particular utility when away from home or traveling with limited access to bedding. They provide particular utility for traveling light, as the bag is condensable into a smaller volume, and opens to provide a full-body blanket enclosure.

Sleeping bags are also very popular for children during sleepovers and overnight visits with friends and family, as the bag provides a convenient sleeping pad and cover in the absence of an available bed or extra linens. During such events, it is common for children to engage in games and other activities for enjoyment and celebration. For board games in particular, this requires the user to transport the game separately to the visit location. The present invention provides a new sleeping bag device that offers users the ability to transport both a sleeping bag and a board game in a single assembly. The present invention provides a removable inner liner that acts as a both a blanket while stowed within the bag, and a game board having indicia thereon for use as a board game. The liner is removable and includes a first and second surface, which may contain a first and a second game board thereon. Game pieces are provided within a storage pouch within the bag, wherein the pieces are compressible objects that do not disrupt the condensing of the bag and further may provide a cushion while stowed within the pouch. It is desired to offer a flexible combination board game and sleeping bag for all users, and in particular young children who may be engaging in overnight visits with friends.

2. Description of the Prior Art

Sleeping bag devices of the general type and those having removal liners have been disclosed in the prior art that relate to the present invention. These include devices that have been patented and those that have been disclosed published patent application publications. While these devices provide a sleeping bag structure and a means for including a game, these devices fail to provide a device that offers storage of a blanket liner having one or two game board indicia thereon, wherein the liner is removal for use in a board game. Further, the devices in the prior art do not provide a storage pouch for game pieces, and further do not disclose the novel features of the associated game pieces, which act as a cushion within the pouch when stowed. The devices listed below are considered the most relevant devices to the present invention, and are presented for the purposes of identifying differentiating features of the present device that adds particular novelty within the field of sleeping bag and entertainment devices.

Specifically, U.S. Pat. No. 6,158,068 to Pariseau discloses a sleeping bag comprising an outer case having an exposed surface and a coextensive liner secured together along their edges to form a pad that may be folded in half to form a pad. The liner and outer case are releasably secured along the bottom and side of the pad opposite the fold. The exposed surface of the liner bears indicia representing a game board or field, while the exposed surface of the outer case carries a design whose motif suggests the game board activity. While the Pariseau device comprises a combined game board and sleeping bag device, there is not mention of game piece storage along the sleeping bag. It is common for sleeping bags to be taken on trips where storage is at a premium. The present invention provides both a game board and sleeping bag, along with storage for associated game pieces. The storage comprises a securable compartment, wherein the game pieces themselves are constructed from a flexible or compressible material such that the pieces may form an internal cushion within the compartment. The compartment may be placed away from the user along the bag, or alternatively at the head of the bag wherein the game pieces serve as a head cushion or pillow when stowed.

Another such device is U.S. Published Patent Application No. 2006/0075554 to Zheng, which discloses a sleeping apparatus having an outer layer and an inner liner superimposed and coextensive with the outer layer. An amusement feature is provided on either the outer layer or the inner liner, while a rigid pad is positionable between the two to form a panel upon which a game may be played. The panel game board is then removable from the outer layer and positionable as desired for playing the game. Similar to the Pariseau device, the Zheng disclosure offers a combined sleeping bag or mat with a game board, wherein the game board is adapted to accept a rigid panel for creating a stiff board structure. No mention of game piece storage or the use of a flexible inner liner as the game board is disclosed.

The present invention discloses a new sleeping bag bed having a removable game board liner and a pouch to store associated game pieces. The game pieces themselves comprise a flexible or compressible material to form a cushioned pouch interior during storage thereof within the pouch. The devices in the prior art disclose sleeping bag games, but fail to disclose the novel features of the present invention. It is therefore submitted that the present invention is substantially divergent in design elements from the prior art, and consequently it is clear that there is a need in the art for an improvement to existing combined sleeping bag and board game devices. In this regard the instant invention substantially fulfills these needs.

SUMMARY OF THE INVENTION

In view of the foregoing disadvantages inherent in the known types of sleeping bag and board game devices now present in the prior art, the present invention provides a new sleeping bag wherein the same can be utilized for providing convenience for the user when stowing and deploying a board game while traveling or otherwise utilizing a sleeping bag.

It is therefore an object of the present invention to provide a new and improved sleeping bag and board game device that has all of the advantages of the prior art and none of the disadvantages.

It is another object of the present invention to provide a sleeping bag that includes the ability to support a board game and associated board game pieces within its structure, wherein the board itself functions as both a playing surface and an inner liner that may provide increased insulation and comfort.

Another object of the present invention is to provide a sleeping bag that includes an inner liner that doubles as a game board, wherein the liner may include different boards on each surface thereof.

Yet another object of the present invention is to provide a sleeping bag that includes a board game piece storage pouch and game pieces that may serve as cushioning within the pouch for head or leg pillow purposes.

A final object of the present invention is to provide a sleeping bag having an exterior design that illustrates the associate game or games provided on the inner liner, such that the sleeping bag is attractive and suited for marketing the specific game and product.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
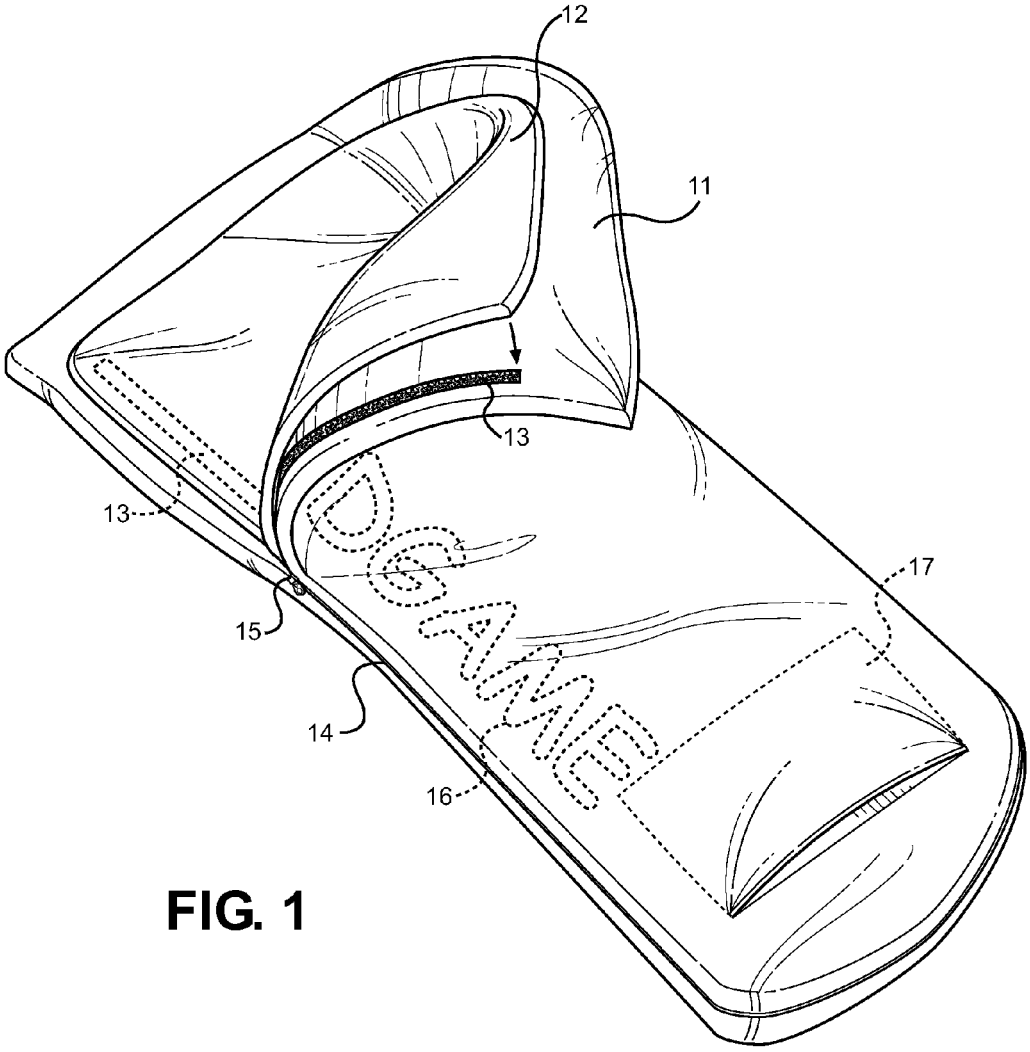
FIG. 1 shows an overhead perspective view of the present invention in a partially unzipped configuration to highlight its internal and external structure.

Reference is made herein to the attached drawings. Like reference numerals are used throughout the drawings to depict like or similar elements of the sleeping bag board game. For the purposes of presenting a brief and clear description of the present invention, the preferred embodiment will be discussed as used for providing an inner having a board game surface and a means to store and deploy associated game pieces. The figures are intended for representative purposes only and should not be considered to be limiting in any respect.

Referring now to FIG. 1, there is shown an overhead perspective view of the combination sleeping bag bed and board game device of the present invention in a partially opened state. The sleeping bag itself comprises a structure that is commonly known in the art of camping and sleep coverings, wherein an outer covering 11 is provided being of uniform material or a sandwich construction having insulative or compressible material filling. The covering is adapted to fold in half onto itself to create a folded edge, a top and bottom open edge and an open side edge. Along the bottom and side edge is a zip fastener 14 and associated zipper clasp 15, which allows the open side and bottom edge to be joined and form an interior volume within which a user is positioned and an open top edge for the user to have free access to the open air. Within the interior of the sleeping bag outer covering 11 is a liner 12 that is formed along the interior surface of the outer covering and spans between the two side edges of the covering. The liner 12 is an additional blanket or sheet that is removably attached to the outer covering interior surface by a line of connection 13 or suitable attachment means, including hook and loop fastening, buttons or snaps.

The interior liner 12 comprises a first and second side and is coextensive with the interior surface of the outer covering 11 until terminating at its attachment means. At least one side of the liner 12 comprises a game board, playing field or activity surface upon which a user may place game pieces, cards or utilize in an activity that facilitates fun and enjoyment. Specifically, indicia are provided on at least one side of the liner 12 such that removal of the liner from the covering 11 and placement of the liner on a surface allows users to play a game or activity thereupon. Along the exterior of the outer covering 11 is provided a logo 16 or further indicia that indicates the special nature and game-carrying capacity of the bag, and further may communicate the name of the associated game.

Along with the outer covering 11 and internal line 12 of the sleeping bag structure, there is provided a storage pouch 17 along the outer covering 11 to allow storage of associated game pieces to be utilized on the liner game board 12. The pouch 17 is one that includes an enclosable interior volume and an outer flap having a closure means to secure said interior volume. The placement of the pouch may include several areas on the outer covering. FIG. 1 shows the pouch 17 positioned at the base of the outer covering 11 and near the feet of a sleeping user. A preferred embodiment of the pouch position is near the head region of the outer covering 11, such that the pouch 17 may be filled with cushioning material for use as a pillow and improved comfort. The cushioning material is further preferred to be the game pieces themselves. The game pieces are provided as flexible or compressible members such that they may be placed within the pouch 17 and act as additional cushioning. The flexibility and compressible nature of the game pieces further do not prevent the sleeping bag from being rolled or condensed into its stowed state.

Figure 2:
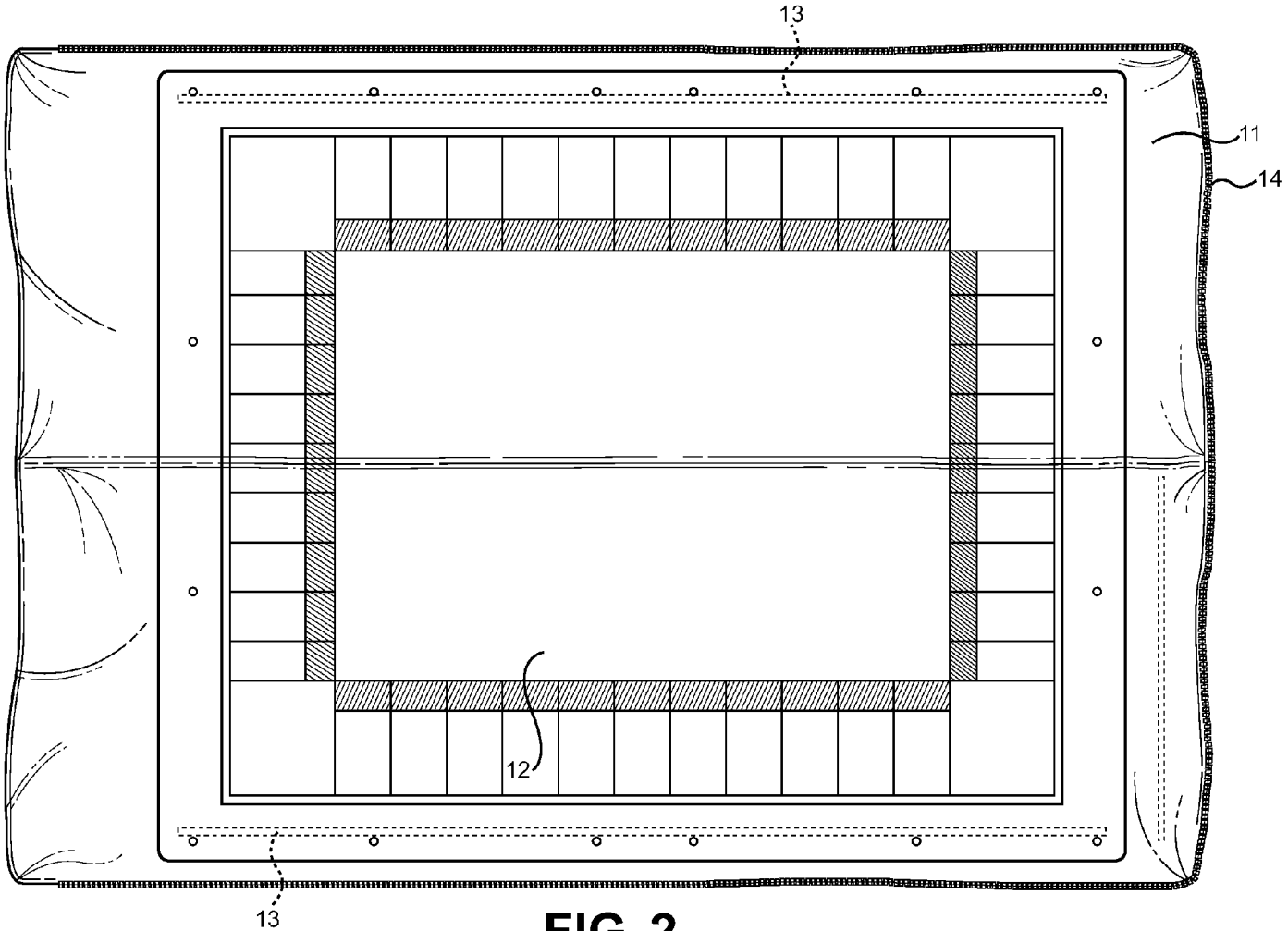
FIG. 2 shows an overhead view of the present invention in an open and unzipped configuration.

Referring now to FIG. 2, there is shown an overhead view of the sleeping bag device in an open position, wherein the game board inner liner 12 is shown attached to the outer covering 11 along its attachment means 13. As shown, the liner 12 follows the inner contour of the outer covering between is first and second side edge and coextensively therealong its inner surface. The liner 12 comprises a sheet, blanket or suitable linen or bedding material that provides increased comfort or thermal insulation for a user when stowed and inside the bag. On the surface of the liner is provided indicia for a specific board game, activity or layout for a playing surface. The liner 12 is removed from the interior of the covering 11 and placed by itself, or alternatively utilized while still connected to the covering 11. Game pieces may be utilized in conjunction with the board, and further activities may be engaged on the liner surface. It is contemplated that any game or activity requiring a board, mat or playing surface be accommodated by the present invention, wherein embodiments of the liner material and indicia provide a suitable useable surface therefor.

Figure 3:
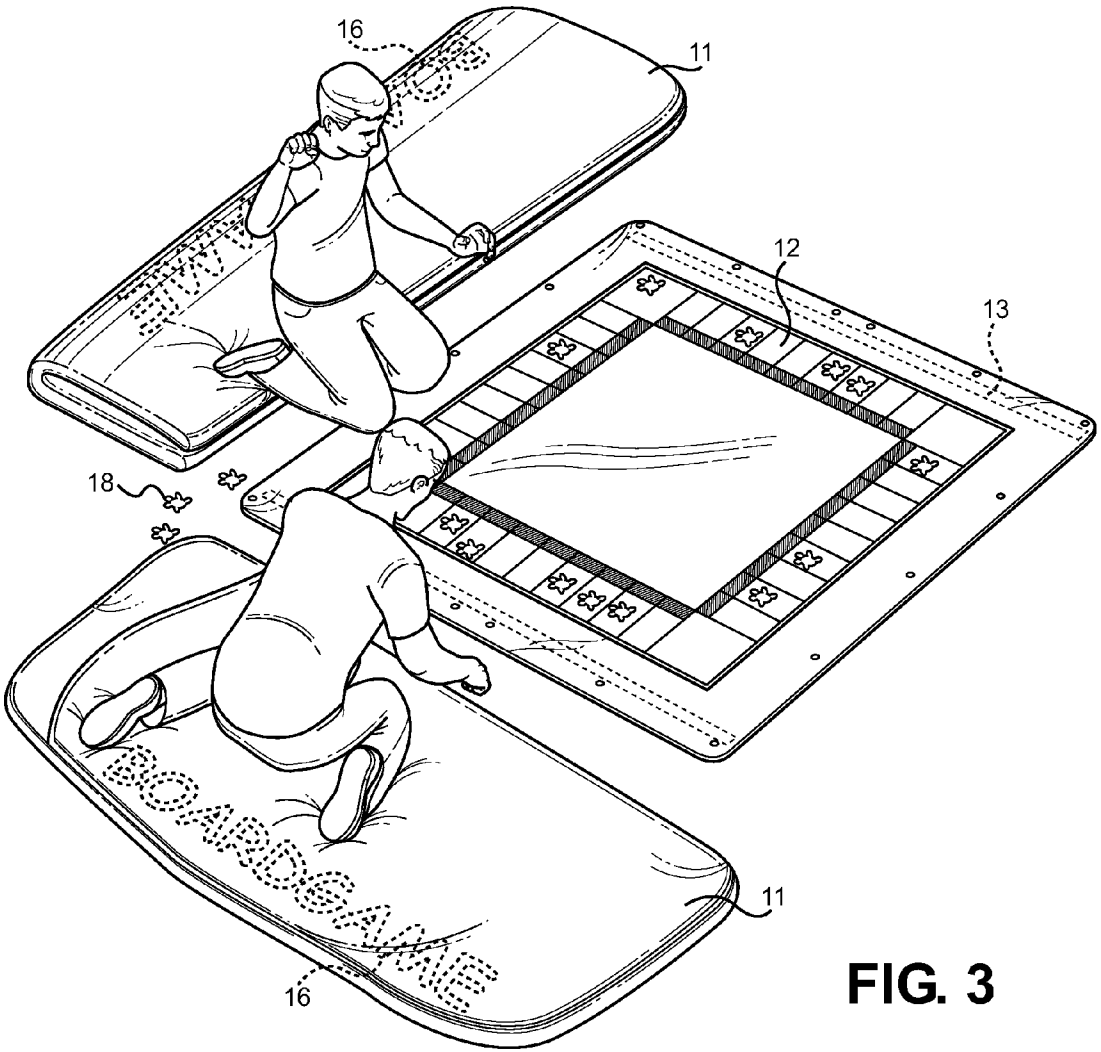
FIG. 3 shows an overhead perspective view of the present invention in a working state.

Referring now to FIG. 3, there is shown a perspective view of the present sleeping bag game board device in a working state. In use, the game board liner 12 may be laid onto a flat surface for which users to gather around and utilize associated game pieces 18 thereon. The liner 12 is independent of the sleeping bag covering 11, therefore the covering may act as a cushioned seat and be utilized separately. Along the exterior of the bag is provided indicia or logos of the specific game for which the liner 12 may be suited for, including various board games and activities requiring a mat.

Along with the sleeping bag and board game apparatus, the present invention includes an associated method that involves the use of a sleeping bag as a transport medium for a game board and associated game pieces, wherein the board is a liner that doubles as interior bedding or linen. Specifically, the present method comprises the forming a game board from a flexible liner material adapted to secure within the interior of a sleeping bag, that liner having at least one playing surface and the sleeping bag covering having a pouch to store a plurality of game pieces therein. The flexible nature of the liner and the game pieces do not interfere with the normal operation of the sleeping bag or its ability to roll or stow. Further, the game pieces provide extra cushioning within the pouch if desired as a head or body pillow. The method further comprises storing the board game within the sleeping bag for improving transportability of the game, and further providing entertainment while traveling or away from home. Traditional board games can be bulky and may be difficult to transport or store, preventing children from being able to bring them to a friend's or relative's house for play. Further, children living through periods of abrupt transition or turmoil due to natural disasters and other circumstances may wish to play games, but may be limited to basic essential possessions. The present invention is well suited for addressing these user's needs.

A further advantage provided by the present device and method includes addressing the drawback of traditional board games that may be too small for several people to comfortably play at once. This may deter families from playing the games, thus reducing the amounts of time spent together. The size of the present invention game board is designed to encourage families to set aside time to play together. Enlarged playing pieces for each specific game allow for use with the larger board, and further make the game a unique means of playing a board game. The pieces may match the shapes and colors of the pieces used for traditional popular board games, but are enlarged and made of flexible or compressible and lightweight material.

The unique aspects of the present invention are primarily directed for use by children in play situations with friends or family members at sleepovers, during camping trips or when away from the home. In light of the prior art and the foregoing disclosure, it is submitted that the present invention is a new and unique device that advances the art of sleeping bags and board game devices. It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination sleeping bag and board game, comprising:

a plurality of game pieces constructed of a deformable, depressible, cushion fill material;

an outer covering having a first and second side edge and a top and bottom edge, said first and second edges adapted to be joined and said covering to fold in half;

said covering having a closure means to join its folded bottom edges and side edges together to form an interior volume having an interior surface;

a flexible liner coextensive along said outer covering interior surface and removably attached thereto by an attachment means;

said liner having a first and second side surface, said liner having a game or activity indicia on at least one side surface of said liner;

said outer covering further comprising a removably securable pouch adapted to accept game pieces associated with said game or activity, and wherein said pouch is a cushion when said game pieces are inserted therein.

2. The device of claim 1, wherein said outer covering further comprises an outer surface having indicia indicating said liner game or activity.

3. The device of claim 1, wherein said pouch is removably securable along one half of said top surface, and wherein insertion of said game pieces into said pouch creates a cushion that is positioned beneath a user's head while sleeping within said outer covering interior volume.

* * * * *